United States Patent [19]

Koenuma

[11] 4,268,969

[45] May 26, 1981

[54] UNIVERSAL PARALLEL RULER INCLUDING SCALE SETTING DEVICE

[75] Inventor: Masao Koenuma, Tokyo, Japan

[73] Assignee: Asahi Seimitsu Kabushiki Kaisha, Tokyo, Japan

[21] Appl. No.: 41,420

[22] Filed: May 22, 1979

[30] Foreign Application Priority Data

May 30, 1978 [JP] Japan ..... 53-65212
Sep. 18, 1978 [JP] Japan ..... 53-114360
Feb. 20, 1979 [JP] Japan ..... 54-18764

[51] Int. Cl.[3] ..... B43L 13/08
[52] U.S. Cl. ..... 33/438
[58] Field of Search ..... 33/1 M, 1 N, 438–442, 33/443, 447; 364/560–564; 250/231 SE, 237 G; 235/92 DN, 92 MP, 92 MT

[56] References Cited

U.S. PATENT DOCUMENTS 4,151,649 5/1979 Tatsuzawa ..... 33/1 N

*Primary Examiner*—Harry N. Haroian
*Attorney, Agent, or Firm*—Birch, Stewart, Kolasch & Birch

[57] ABSTRACT

A universal parallel ruler is disclosed. A desired angle of rotation of a preset member relative to a base line is selected. This angle of rotation is introduced into the ruler via an input station mounted on the ruler. The desired angle of rotation of the preset member is displayed on a display and an input signal representative of this desired angle of rotation is input to a comparator. The preset member is rotated. A detector detects the actual angular position of the preset member relative to the base line and it introduces another input signal to the comparator representative of the actual position of the preset member relative to the base line. When the actual angular position of the preset member equals the desired angle of rotation, of the preset member that is, when the two input signals to the comparator are approximately equal, a coincidence signal is generated which may light a lamp, indicative of this coincidence, and may activate a braking mechanism which will function to apply a braking force to the preset member, thereby preventing further angular rotation of the preset member and preventing the actual angular position of the preset member from exceeding the desired angle of rotation of the preset member input via the input station. The scale is then rotated to the new position of the preset member and locked in its new position. Alternatively, a desired angle is memorized in the input station and input to a comparator. The actual position of the scale is input to the comparator. Upon coincidence, an output from the comparator brakes the scale rotation.

12 Claims, 7 Drawing Figures

SW20
133
126
7 8 9 C
4 5 6 AC
1 2 3 R
0 • M
+ −
137
148
147
146
134
139
140
141a
141b
142
143
143a
143b
135a
135b
135c
135d
135e
136a
136b
136c
136d
136e
136f
127a
127b
127c
127d
127e
127f
128
144a
144b
144c
144d
144e
144f
144g
145

UNIVERSAL PARALLEL RULER INCLUDING SCALE SETTING DEVICE

BACKGROUND AND SUMMARY OF THE INVENTION

The present invention relates to a device for the angular setting of a scale mounted on a head of a universal parallel ruler.

In the universal parallel ruler of prior art, a square comprising a horizontal scale and a vertical scale is rotatably supported in a stationary support on a ruler head so that said square may be set to a position deviating by a desired angular distance from a basic line position at which the horizontal scale is horizontally located and the vertical scale is vertically located on the drawing board. The amount of such angular deviation or rotation of the square is usually read from a protractor mounted on said stationary and a vernier mounted on the square. Recently it has been proposed to read this amount from an electric digital display means comprising an encoder interposed between the stationary support and a rotatable portion on the side of said square. However, with the conventional methods and means as mentioned above, the operator must rotate the square or scale to a desired angular position to effect a desired angular setting of the scale, following the protractor's graduations or the digital value, both of which continuously vary as the scale is rotated thereby requiring the user's concentrated attention.

In accordance with the present invention, these disadvantages associated with the conventional device are eliminated. The present invention comprises a universal parallel ruler including a device for angular setting the scale, in which, when a desired angle of rotation is applied by the operator into an input station, this angle is digitally displayed on a display station and simultaneously this input signal is supplied to a comparator to which is also supplied an output signal from a detector adapted to detect an actual angular position of the scale, said comparator providing, when the scale has been correctly set to the desired angular position, a coincidence signal in accordance with which a display lamp or the like of a display station is lit so that the operator may set the scale to the desired angular position simply by observing this display.

In addition, the present invention also includes a device for angular setting the scale, in which, when a desired angle of rotation is supplied by the operator to an input station, this angle is digitally displayed on a display station and simultaneously this input signal is supplied to a comparator to which is also supplied an output signal from a detector which is adapted to detect an actual angular position of the scale. When the scale has been correctly set the desired angular position, the comparator provides a coincidence signal which in turn activates a braking means such that the operator may set the scale to the desired angular position simply by rotating the scale.

Accordingly, a principal object of the present invention is to overcome the drawbacks of the prior art device by providing a device for angular setting the scale of a parallel ruler such that, when a desired angle of rotation is given to the device as an input signal, this angle is digitally displayed by a display means and the angular setting of the scale is immediately completed.

An additional object of the present invention is to provide a device for angular setting the scale utilizing various means for automatically preventing the scale from being rotated once the scale has achieved its desired position and means for freely establishing a position to which the scale has been rotated by a given angle as a basic line position of the scale, means to prevent the scale from being further rotated beyond a limit position even when a scale setting beyond this limit is intended, means enabling a scale setting with addition or subtraction of a desired angle to or from a given angle of previous rotation, and means for provisionally setting a position corresponding to rotation of the scale by a given angle.

Other objects and further scope of applicability of the present invention will become apparent from the detailed description given hereinafter; it should be understood, however, that the detailed description and specific examples, while indicating preferred embodiments of the invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
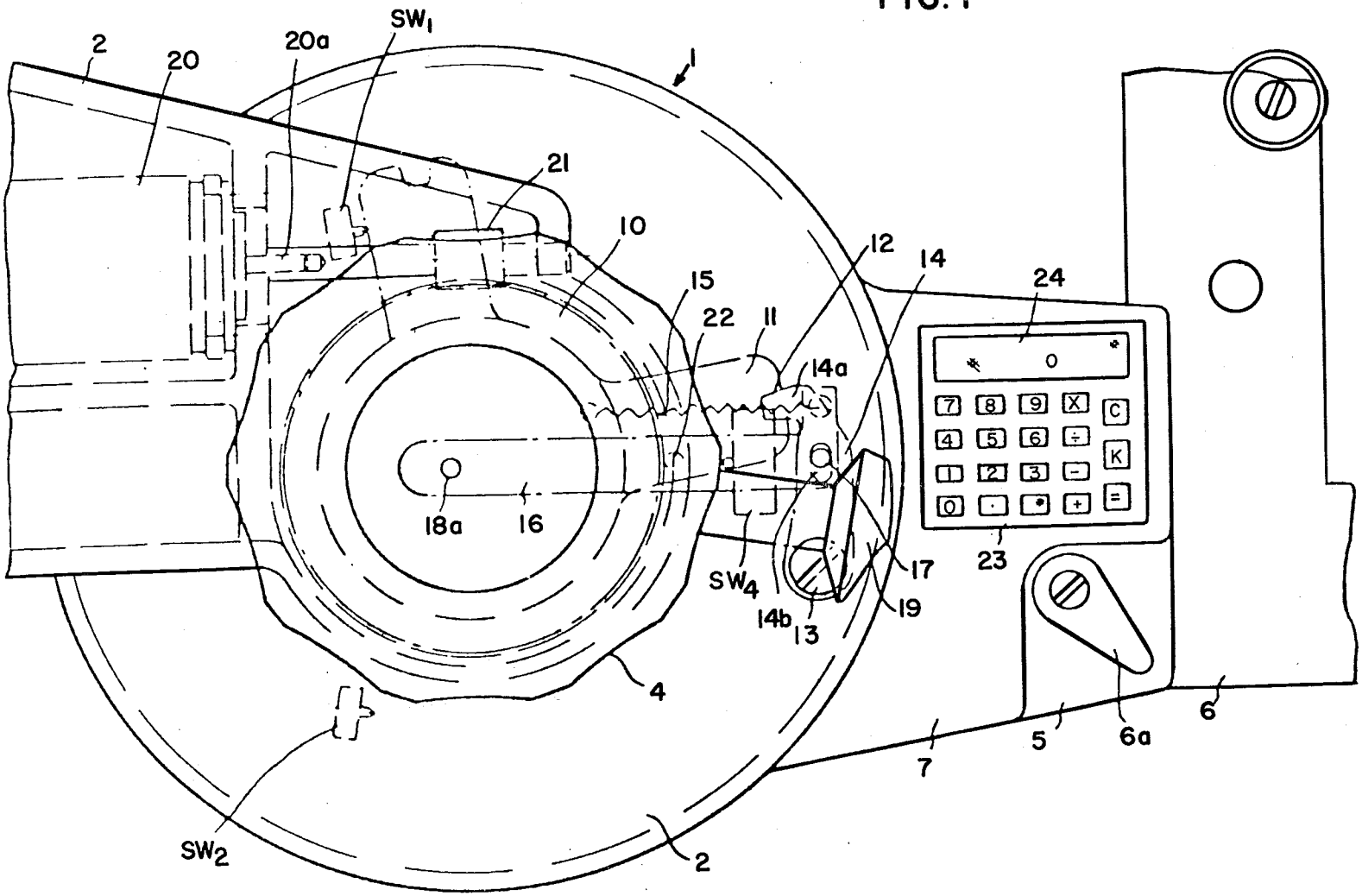
FIG. 1 is a plan view showing an important part of an embodiment of the present invention.
Figure 2:
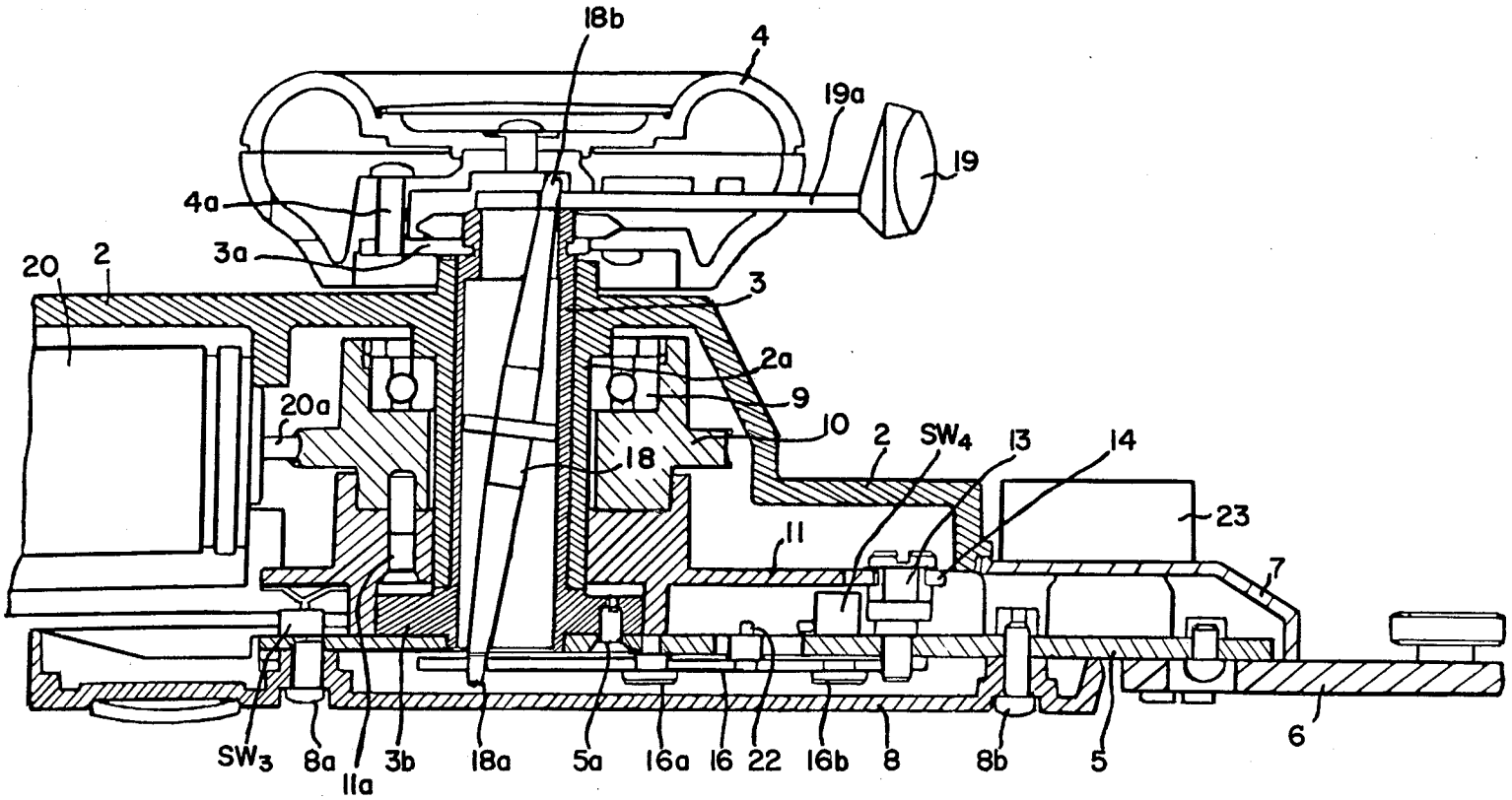
FIG. 2 is a front view showing the embodiment of FIG. 1 in axial section.

Referring to FIGS. 1 and 2, reference numeral 1 designates a head movably guided over a drawing board, while maintaining a scale in parallel relation thereto. The universal parallel ruler to which this head 1 belongs may be the track type or the arm type. Reference numeral 2 designates a support frame for the head 1 which is stationary with respect to rotation of the scale and centrally including a bearing 2*a* in the form of a hollow cylinder. A hollow head shaft 3 is rotatably supported in said bearing 2*a* and has adjacent its upper end a connector plate 3*a* to which an operating head 4 is integrally fixed by a screw 4*a*. The head shaft 3 has adjacent its lower end a flange 3*b* to which a scale carrying plate 5 is integrally fixed by a screw 5*a*. A scale mounting plate 6 is mounted on the scale carrying plate 5 so that a basic line for the scale may be finely adjusted by a lever 6*a* for fine adjustment. Reference numeral 7 designates a frame provided on the upper side of the scale carrying plate 5 and is adapted to be rotated together with the scale along the outer periphery of the support frame 2 for the head as the scale carrying plate 5 is rotated. Reference numeral 8 designates a bottom plate of the head 1, fixed by screws 8*a*, 8*b* to the scale carrying plate 5 on the lower side. Reference numeral 10 designates a worn wheel rotatably supported by a bearing 9 around the bearing 2*a* and having on its lower side a preset member 11 according to the present invention integrally fixed thereto by a screw 11*a*. The preset member 11 includes a projection extending above and in parallel to the scale carrying plate 5, a front end of said projection being provided with a notch 12 which forms a part of a locking means according to the present invention. Another part of this locking means is constituted by a pawl 14 pivotally mounted on the scale carrying plate 5 around a pivot 13 and having a front end 14*a* biased under the action of a tension spring 15 to be engaged into said notch 12. Reference numeral 16 designates an operating lever for said pawl 14, which is movably guided by guide screws 16*a*, 16*b* mounted on the scale carrying plate 5 from side to side as in FIGS. 1 and 2. The operating lever 16 has at its front end a link pin 17 engaged into a hole 14*b* extending through the pawl 14 and at its rear end a connector hole into which a lower end 18*a* of a lever 18 mounted within said hollow head shaft 3 is received. The upper end 18*b* of said lever 18 is connected to an actuator piece 19*a* of an index lever 19 mounted on the operating head 4. Accordingly, when said index layer 19 is pushed leftwards as in FIG. 2, the operating lever 16 is rightwardly urged against a resiliency of the tension spring 15, causing the pawl 14 to swing away from the notch 12 of said preset member 11, and thereby a locking relationship between the preset member 11 and the scale carrying plate 5 is cancelled. When a pushing force upon the index 19 is removed, the pawl 14 is brought again under the resiliency of the tension spring 15 to the position at which said pawl 14 is engaged into the notch 12 of said preset member 11 and thus the locking means is activated again. Within the head supporting frame 2, there is stationarily provided a step-motor 20 as a drive means serving the present invention, and a drive shaft 20*a* thereof integrally carrying a worm gear 21 adapted to be engaged with said worm wheel 10. Thus, forward or backward rotation of the stepmotor 20 serving as the drive means causes the preset member 11 to be rotated through the worm gear 21 and the worm wheel 10 together forming a drive transmitting mechanism counterclockwise or clockwise, respectively, as in FIG. 1.

Accordingly, two different possibilities can be contemplated namely, the first possibility is that the preset member 11 alone is rotated by a given angle with said locking means out of its operative position and the second possibility is that the preset member 11 is rotated together with the scale carrying plate 5 with said locking means in its operative position. The embodiment shown relies upon the former possibility, in which the preset member 11 alone is previously set to a given angle of rotation, then the scale is manually rotated by the operator, and the desired angular setting of the scale is completed by locking the scale carrying plate 5 by the locking means on the preset member 11. Although this embodiment has been arranged in such a manner as to reduce a load exerted on the drive means and the drive transmitting mechanism, on the one hand, and to facilitate quick and smooth operation of the preset member 11 on the other, the design may be modified so as to rely upon the latter possibility as previously mentioned, i.e., the preset member 11 may be angularly set together with the scale carrying plate 5, as long as a proper measure is taken to strengthen the drive means and the drive transmitting mechanism as well as to lift the scale above the drawing board during rotation of the scale.

At a critical position of counterclockwise rotation of the preset member 11, the head supporting frame 2 carries a switch $SW_1$ serving as a rotation limiting switch mechanism for said preset member 11 and, at a critical position of clockwise rotation, a similar switch $SW_2$ is provided so that, when the preset member 11 bears against these switches $SW_1$, $SW_2$, these switches are respectfully activated to stop a drive exerted upon said preset member 11. The scale carrying plate 5 also carries a switch $SW_3$ serving as a switching mechanism to hold the preset member 11 on the basic line position of the scale, so that the switch $SW_3$ is activated only when the preset member 11 is driven back to the basic line position of the scale to stop the drive means, assuring that the preset member 11 will be set to the basic line position of the scale. The specific embodiment shown is of the type in which the preset member 11 alone is rotated for angular setting of the scale, and, accordingly, there is provided a switch $SW_4$ serving as a switching mechanism which is activated when the lock means is brought out of its operative position energizing the drive means. As shown, the switch $SW_4$ is carried by the scale carrying plate 5 adjacent the lock means and is adapted to be activated by a pin 22 planted on the operating lever 16 for the lock means when said pin 22 bears against the switch $SW_4$ as the index lever 19 causes the lock means to be brought out of its operative position.

Reference numeral 23 designates input means stationarily mounted on the upper side of the frame integrally therewith by which a scale angle to be set is input, and reference numeral 24 designated a numerical value display means and adapted for digital display of an input signal applied to said input means so that the operator may visually recognize the scale angle actually input by said input means. Although the embodiment shown adopts the input means of the key input (or Digital) type, it is also possible to replace this by the rotary dial type in which a scale angle to be set is input as an analog amount.

With an input means of such rotary dial type, a rotation amount of the dial is read by a potentiometer or an encoder so that, in the case of the former, the angle read thereby may be digitally converted by an A-D converter and then digitally displayed on the numerical value display means, and, in the case of the latter in which the angle is read by the encoder as a digital amount, this amount may be directly displayed on the numerical value display means. Thus, the operator may only rotate the dial while observing the indication on said numerical value display means to input a scale angle to be set, as desired.

Figure 3:
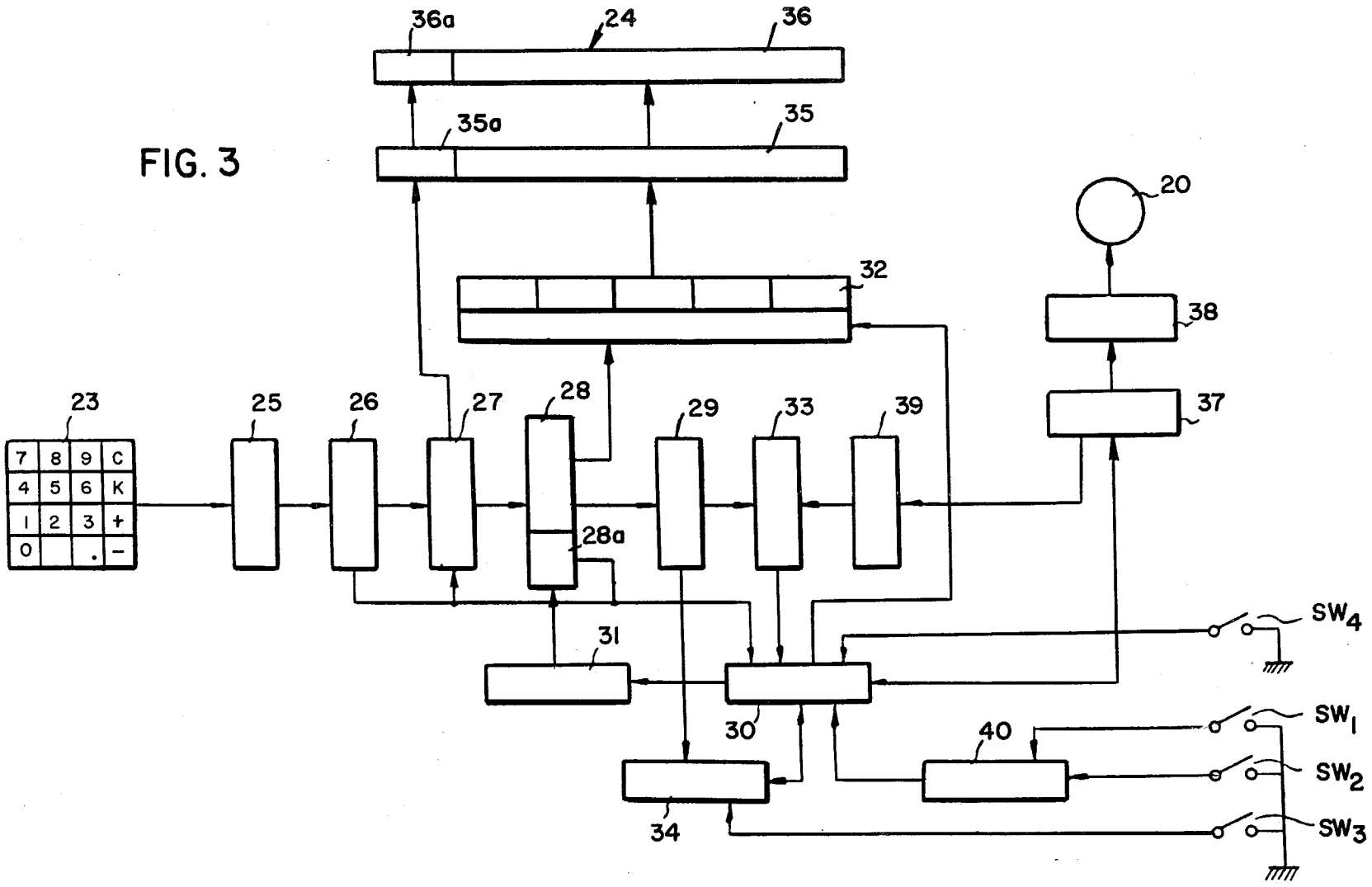
FIG. 3 is a block diagram illustrating this embodiment.

The device according to the present invention will be described further in detail with reference to a block diagram of FIG. 3. In normal operation, to rotate the scale, lying on a basic line position, by a desired angle, for example, counterclockwise 25°30′, the operator puts a number +25.30 on a key section of the input means. Such manner of putting the number is similar to that in the ordinary computer, in which a positive (+) polarity is given to the counterclockwise rotation of the scale while a negative (−) polarity is given to the clockwise rotation thereof but it is not required to push the key + key when the counterclockwise rotation is concerned. The input signal applied to this input means 23 is supplied through a decoder 25 to a temporary memory 26, a polarity discriminator 27, an up-and-down counter 28 and a control circuit 30, further to a pulse generator 31 which, in turn, generates a pulse signal of + direction with which the up-and-down counters 28, 32 are activated. Counts of the up-and-down counter are supplied through a shift register 29 provided on the side of the display means to a comparator memory 34. In the embodiment shown, the up-and-down counter 32 corresponds to a numerical value of five positions and has five windows consisting (viewed from the left hand as in the block diagram) of a window for 100° unit binary displayed with 1 and 2, a window for 10° unit decimally displayed with 0 to 9, a window for 1° unit decimally displayed also with 0 to 9, a window for 10′ unit six digit displayed with 0 to 5 and a window for 1′ binary displayed with 0 to 5. Operation of this up-and-down counter 32 causes a decoder driver 35 to be activated so that an angle of 25.30 applied to the input means 23 is displayed on the numerical value display means 36, while the polarity discriminator 27 provides a signal with which a driver 35*a* is activated so that a display of + appears on a polarity display means 36*a*. Now the operator can visually recognize the very angle actually put into the input means 23 from the numerical value display means 36. Then, the operator may depress the index lever 19 of the operating head 4 to release the lock means. The switch $SW_4$ is activated thereby and a pulse generator 37 provided on the side of the drive means is applied with a drive signal (of + direction) from a control circuit 30, with which a motor driver 38 is activated to rotate the step motor 20. This results in counterclockwise rotation of the preset member 11 through the drive transmitting mechanism 21, 10. Such rotation of the preset member 11 continues until the control circuit 30 deenergizes the pulse generator 37 and simultaneously the motor driver 38 as well as the step motor 20 are thereby stopped when the comparator 33 determines a coincidence of the signal applied from said pulse generator 37 to the shfit register 39 with the signal from the shift register 29 on the side of the display means.

The position at which the rotation of the preset member 11 has been stopped corresponds to the angle digitally displayed on said numerical value display means 36. Accordingly, the operator may rotate the scale, holding the operating head 4, to the angular position at which the preset member 11 has been thus set and then bring the pawl 14 of the lock means into the notch 12 formed in the preset member 11 to effect a desired setting of the scale to a position deviating from the basic line position by a given angular distance and thereby to complete the desired angular setting of the scale.

Now, we will consider the situation in which the scale is set to a new position and will be reached by the scale after clockwise or counterclockwise further rotation thereof by a desired angle from the position to which the scale has previously been set as above mentioned. Upon placing the desired angle together with a polarity of + or −, for example, −5.15 on the input means 25, an input signal is applied through the decoder to the temporary memory 26, the polarity discriminator 27, the up-and-down counter 28 and the control circuit 30. The pulse generator 31 on the side of the display means is now activated and said up-and-down counter 28, according to the pulse signal of negative polarity provided from said pulse generator 31 and under action of a control circuit 28*a* associated with said up-and-down counter 32 of five positions the decoder driver 35 and causes the numerical value display means 36 to display the numerical value of 5.15. On the polarity display means 36*a* the polarity of − appears in accordance with the signal provided from the polarity discriminator 27. When the operator depresses the index lever 19 to release the lock means and thereby to close the switch $SW_4$ while visually observing the indication on the numerical value display means 36, the pulse generator 37 on the side of the drive means is applied with a drive signal of negative (−) polarity from the control circuit 30 and, with this drive signal, the step motor 20 continues to be driven through the motor driver 38 until the signal from the shift register 39 on the side of the motor will coincide with the signal from the shift register 29 on the side of the display means, and the preset member 11 is rotated thereby to the desired angular position. With a coincidence signal coming from the comparator 33, a signal as a result of addition of subtraction coming from the memory 34 is applied through the control circuit 30 to the up-and-down counter 32 and thereby the decoder driver 35 is activated so that a numerical value after addition or subtraction is displayed on the numerical value display means 36. Simultaneously, the polarity discriminator 27 is also applied with the polarity after addition or subtraction from the control circuit 30 and this polarity after addition or subtraction is displayed under action of the driver 35*a* on the polarity display means 36*a*. Acccordingly, in rotating the scale and then locking the preset member 11 by the lock means, the operator is altered by the numerical value display means 36 how far the scale is to be rotated relative to the basic line position.

When a numerical value is introduced into the input means 23 and when operating the angular setting as above mentioned, if the introduced numerical value exceeds the value corresponding to the rotatable limit of the scale, the limit switch $SW_1$, in counterclockwise direction, and the limit switch $SW_2$, in the clockwise direction, bear against the preset member 11, respectively, and are immediately closed, respectively, so that the pulse generator 37 is immediately applied with a stop signal through a direction discriminator 40 from the control circuit 30, stopping the motor drive 38 as well as the motor 20. The preset member 11 is correctly stopped at the critical position. Obviously a modification is possible such that an overflow is indicated on the numerical value display means when said limit switches $SW_1$, $SW_2$ are closed.

When the power source is switched on again after this has been once switched off, with the scale angularly set relative to the basic line position, the electric circuity assumes the condition as if the scale as well as the preset member 11 have really been rotated away from the basic line position, since the memory 34 has lost its previous content and the numerical value display station 36 has no display. Therefore, a clear input station C adapted for switching OFF-ON of the general power source may be associated with the input means 23 to set the scale position at a given angle of rotation relative to the basic line position as a new basic line position. Based on this new basic line position, a numerical value of desired angle may be applied into the input means 23 to achieve the angular setting scale, if desired.

Furthermore, the basic line position of the scale must be altered as desired in some bases such as exchange of a drawing. In such case, the scale can be rotated independently of the preset member 11 by pushing the index lever 19 so as to disengage the pawl 14 out of the notch 12 and thereby to release the lock means, thereafter the scale may be set to a given new basic line position and then the preset member 11 may be brought into alignment with this new basic line position of scale. To align the preset member 11 with the new basic line position of the scale in this specific embodiment, −K or +K may be applied as input signal to the key input station of the input means 23 to bring the preset member 11 to the basic line position clockwise or counterclockwise, respectively. The lock means has already been released and the switch $SW_4$ is at an open position, so that, upon application of such input signal, the pulse generator 37 is applied from the control circuit 30 with a pulse signal of negative (−) or positive (+) direction which causes the motor driver 38 and the step motor 20 to rotate the preset member 11. When the preset member 11 reaches the basic line position, the switch $SW_3$ is closed. Upon closure of this switch $SW_3$, the memory 34 is cleared and at the same time the control circuit 30 applied the pulse generator 37 with a stop signal, with which the motor 20 is stopped. At this moment the lock means is activated to lock the scale on the preset member 11, resulting in completion of the scale setting the basic line position. It should be noted here that said switch $SW_3$ is adapted to be activated only when an input station K, particularly provided for the signal serving to align the preset member 11 with the basic line position of scale, is operated and closure of this switch at any other points of time has no effect upon the circuitry elements such as control circuit 30.

The input means 23 and the associated numerical value display station 36 may be adapted to be use independently of the drive means for the preset member 11, if desired, and thereby a computer may be incorporated into the head of the universal parallel ruler for further improvement of efficiency of the drawing operation.

With the device according to the present invention, as obviously understood from the aforegoing description, setting of the scale at a desired angular distance relative to the basic line position is completed simultaneously when the angle by which the scale should be rotated relative to said basic line position is digitally displayed on the numerical value display station by application of said angle value into the input means, without annoying procedures usually required to use the device of prior art, with which, for example, scale setting must be performed while observing the result of scale rotation on various instruments such as a protractor. Thus, the device of this invention is excellent in its effect, achieves the objects set forth in the introductory part of this specification and provides various advantages in practical use.

The present invention will be now described by way of example in reference with the accompanying drawing.

Figure 4:
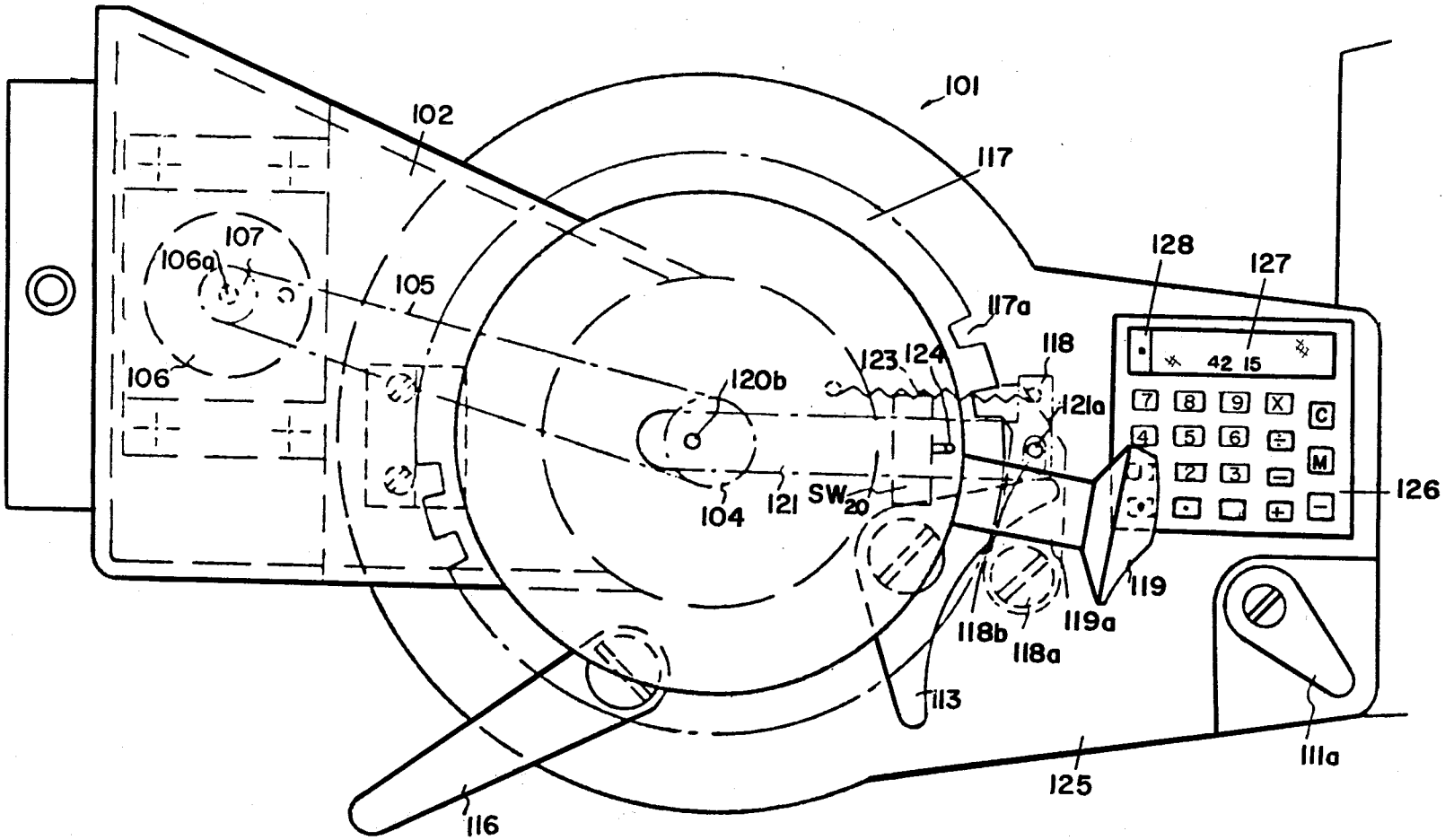
FIG. 4 is a plan view schematically showing an important part of an embodiment of the present invention.
Figure 5:
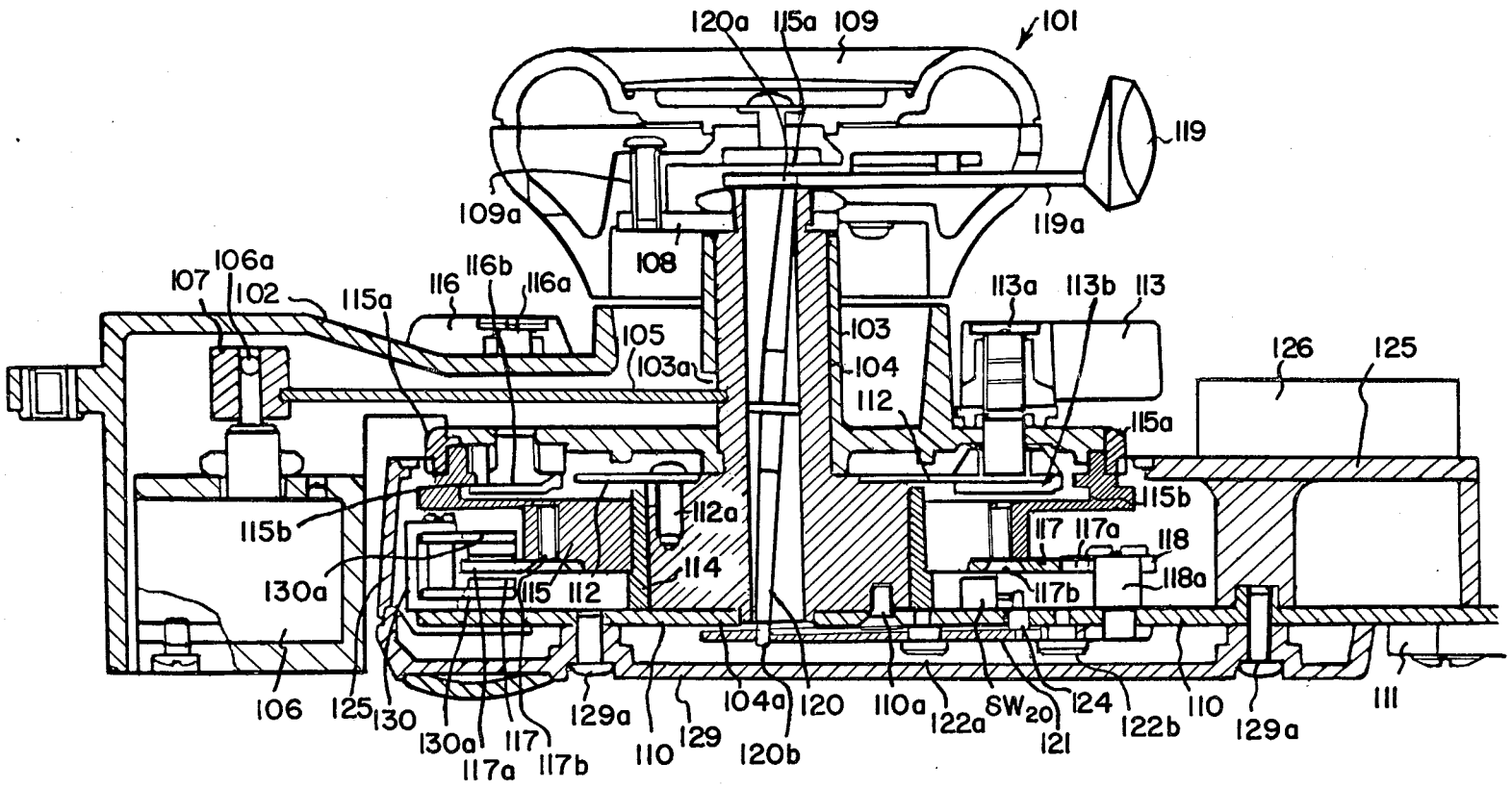
FIG. 5 is a front view showing this embodiment of FIG. 4 partially in axial section.

Referring to FIGS. 4 and 5, reference numeral 101 designates a head movably guided over a drawing board, while maintaining the scale in parallel relation relative thereto, no matter whether the universal parallel ruler to which this head 101 belongs is of track type or arm type. Reference numeral 102 designates a support for said head 101 being stationary with respect to rotation of the scale and centrally including a bearing 103 in the form of a hollow cylinder. A hollow head shaft 104 is rotatably supported in said bearing 103 which has, in turn, at one side thereof a notch 103*a* at which a belt 105 is suspended around the head shaft 104 to to detect a rotation. Reference numeral 106 designates a rotation detector accommodated within the head support 102, which detector may, in the specific embodiment shown, be of analog type such as a potentiometer. Said belt is suspended around a pulley 107 stationarily mounted on a rotary shaft 106*a* of said detector 106. Accordingly, when the head shaft 104 is rotated relative to the head support 102, this rotation is detected by the rotation detector 106. Said head shaft 104 has at upper end a connector plate 108 stationarily mounted thereon and to this plate 108 an operating head 109 is integrally secured by a screw 109*a*. The head shaft has at the lower end, a flange 104*a*. A scale carrying plate 110 is integrally secured by a scarew 110*a* to the bottom of said flange 104*a* and has at an end a scale mounting plate 111 adapted to effect a fine adjustment of the scale basic line with the help of a fine adjustment lever 111*a*. On the upper side of the flange 104 is integrally secured by a screw 112*a*, a circular locking plate 112 having its periphery locked by a locking piece 113*b* of a locking shaft 113*a* adapted to be clamped and unclamped by operating a scale locking lever 113. Around the outer periphery of the flange 104*a* is rotatably mounted a cylindrical member 114 which is, in turn, integrally provided with a basic line adjusting member 115 in the form of a circular disc. The basic line adjusting member 115 has around its outer periphery an operating ring 115*a* to effect rotation of this member 115 and its inner periphery a locking frame 115*b* bearing against a locking piece 116*b* of a locking member 116*a* so that said locking frame 115*b* may be clamped or unclamped by a basic line locking lever 116 mounted on the head support 102. An index disc 117 is integrally mounted by means such as a screw 117*b* on the basic line adjusting member 115, said index disc 117 having notches 117*a* at a predetermined angular distance, for example, 15°, into which are retractably engaged a pawl 118 adapted to be pivotable around a pivot 118*a* on the scale carrying plate 110. Engagement or disengagement of said pawl 118 is controlled by an index lever 119 laterally projecting the operating head 109. Said index lever 119 includes an arm 119*a* adapted to come at its front end in engagement with upper end 120*a* of a lever 120 provided with the hollow head shaft 104 while the lower end 120*b* of said lever 120 is engaged with the rear end of an actuator member 121 which is movable from side to side along the lower side of the scale carrying plate 110, and a link pin 121*a* planted on the from end of said actuator member 121 is engaged into a slot 118*b* formed in said pawl 118 projecting upwards through an opening of the scale carrying plate 110.

Referring the FIG. 5, reference numerals 112*a*, 122*b*, designate guide members stationarily mounted on the lower side of the scale carrying plate 110, by which the actuator member 121 is movably guided from side to side as seen in the figure. The actuator 121 is biased by a tension spring 123 to actuate the pawl 118 normally in the direction (leftwards in figure) of engagement with the notches 117*a*. A contact pin 124 planted on the actuator member 121 projects through an opening 110*b* of the scale carrying plate 110 and is adapted to be brought against a contact of a switch $SW_{20}$ which will be described more in detail later, when the pawl 118 is engaged with said notches 17*a*. Reference numeral 125 designates a casing member integrally mounted on the scale carrying plate 110. This casing member 125 integrally carries thereon a key input station 126 for scale angle, a numerical value display means 128 all according to the present invention. Reference numeral 129 designates a bottom covering member integrally mounted by a screw 129*a* on the bottom side of the scale carrying plate 110.

Reference numeral 130 designates electromagnetic braking means integrally mounted on the scale carrying plate 110 and a pair of actuator members 130*a* associated with this braking means 130 serve to clamp or unclamp said index disc along the periphery thereof.

Figure 6:
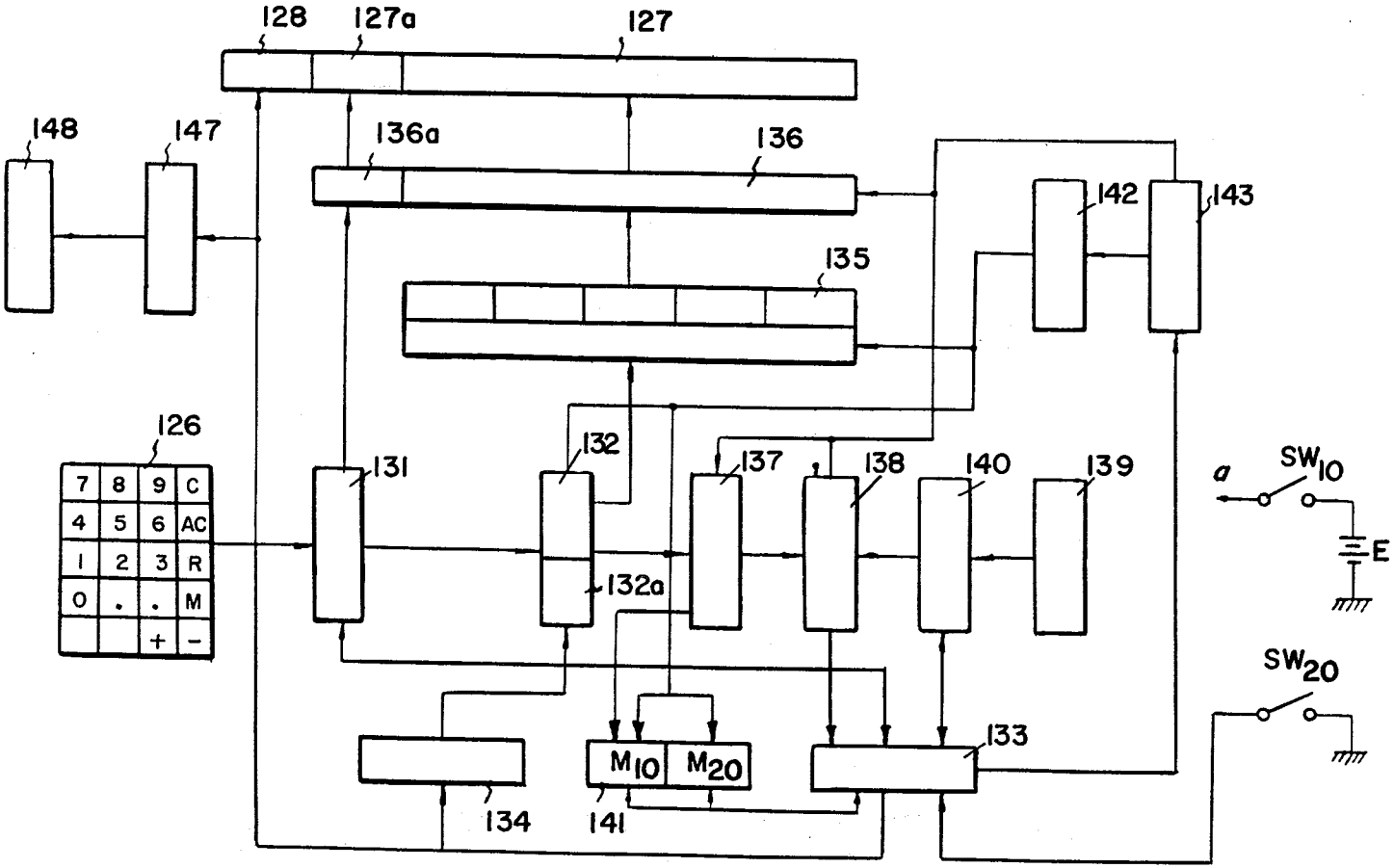
FIG. 6 is a block diagram illustrating the FIG. 4 embodiment.

The present invention will be described further in detail with reference to a block diagram given by FIG. 6.

The key input station 126 functions as a station into which a scale angle to be set is input by the operator together with a polarity representing a direction of rotation and the angle of rotation together with the polarity thus input by the operator is immediately displayed on the numerical value display station 127 and a polarity display station 127*a*, based on which the operator may easily verify the scale angle to be set. Accordingly, the input station may be, instead of key input type as above mentioned, of rotary dial type in which a numerical value is placed on the numerical value display station 127 by rotating the dial. Further, there are many possibilities in execution of the input station and the manner in which this input station should be executed is not specified by the present invention. An angle by which the scale should be rotated from the basic line position, for example, +25°30′, is placed into said key input station 126 and this input signal is supplied to a temporary memory 131, an up-and-down counter 32 and a control circuit 133. A pulse generator 134 now generates a pulse signal of + direction with which the up-and-down counters 132, 135 are activated and a decoder driver 136 causes the numerical value display station 127 to display 125, 130 while a signal from the temporary memory 131 activates a driver 136*a* and thereby causes the polarity display station 127*a* to display + polarity. A signal from the up-and-down counter 132 is supplied to a shift register 137 which, in turn, supplies a signal corresponding the count signal to a comparator 138. When the scale is counterclockwise (i.e., in + direction) rotated, a rotation of the head shaft 104 is transmitted through the belt 105 is to the rotary shaft 106*a* of the analog detector 106 and, particularly in the embodiment shown, an analog signal from said analog detector 139 is (after being converted by an A-D converter 140 into digital signal) supplied to said comparator 138. If said digital signal in accordance with an actual rotation of the scale coincides with the previous signal from the shift register 137, the comparator provides a coincidence signal to the control circuit 133 which supplied, in turn, a solenoid driver 147 of the electromagnetic braking means 130 with a signal causing said solenoid driver 147 to actuate a braking solenoid 148. As a result, the actuator member 130*a* holds the index disc 117 and thereby stops the scale. Simultaneously, the light emitting element of the display means 128 is lit so that the operator may conveniently rely upon such indication on the display means 128 to verify that the scale has been set to the desired rotation angle of 25° 30′. Clamping the scale locking lever 113 and thereby locking the scale at the position thus set enables the electromagnetic braking means to be released to perform further operation of drawing for a long time. The signal from the shift register 137 is stored in a primary memory $M_{10}$ of a memory 141 and the content thus stored in the primary memory $M_{10}$ is directly transferred to a secondary memory $M_{20}$ when a new rotation angle is input.

Now the manner of operation of each key of the key input station 126 will be described.

C designates a clear key adapted to be used when an erroneous numerical value has been introduced. Depression of this key C causes the control circuit 133 to actuate shift register 137 and the primary memory $M_{10}$ may be cleared and thereby a display on the numerical value display station 127 may be erased. A control circuit 132*a* is associated with the up-and-down counter 132 so that the count may be cleared for every placement of a numerical value into the key input station 126 and the next numerical value placed into the input station may be counted as an angle relative to the basic line position. The specific embodiment shown is so arranged that always the angle relative to the basic line position is input into the key input station and the numerical value corresponding to this angle is displayed on the display station. Such an arrangement of this embodiment is based on the actual circumstances of normal drawing operation wherein dimensions are often determined on the basis of the angle relative to the basic line. "AC" designates an all-clear key used for alteration of the basic line position or setting of the new basic line position. This key (AC) activates the reset circuit 142 through the control circuit 133 only in the state in which the pawl 118 is in engagement with the notches 117*a* of said index disc 117 and the contact pin 124 of the actuator member 121 bears against the switch $SW_{20}$ and thereby closes the latter. Thus the electric contents of all the blocks such as the up-and-down counters 132, 135 and the primary memory $M_{10}$ of the memory 141 are cleared. In the specific embodiment shown, energization of the decoder driver 136, the shift register 137, the comparator 138 and the reset circuit 142 through the control circuit 133 is accomplished by the interposition of a delay circuit 143, not only to obtain a period of stabilized circuit operation by also to reduce power consumption by deenergization after a predetermined time duration. Specifically, when a predetermined time duration has elapsed after input has been made into the key input station 126 and thereby the scale has been set, the electromagnetic braking means 130 is deenergized and thereby a display on the display station is erased. "R" designates a recall key adapted to be used to reactivate the delay circuit 143 which has effected deenergization and to light the display station. "M" designates a memory key adapted to be depressed before depression of the recall key "R" to display the content stored in the secondary memory $M_{20}$ of the memory 141 on the display station and before depression of the all-clear-key "AC" to clear all the content in the memory 141. "E" designates a power source, $SW_{10}$ a source switch and a designates the supply source to each block.

Figure 7:
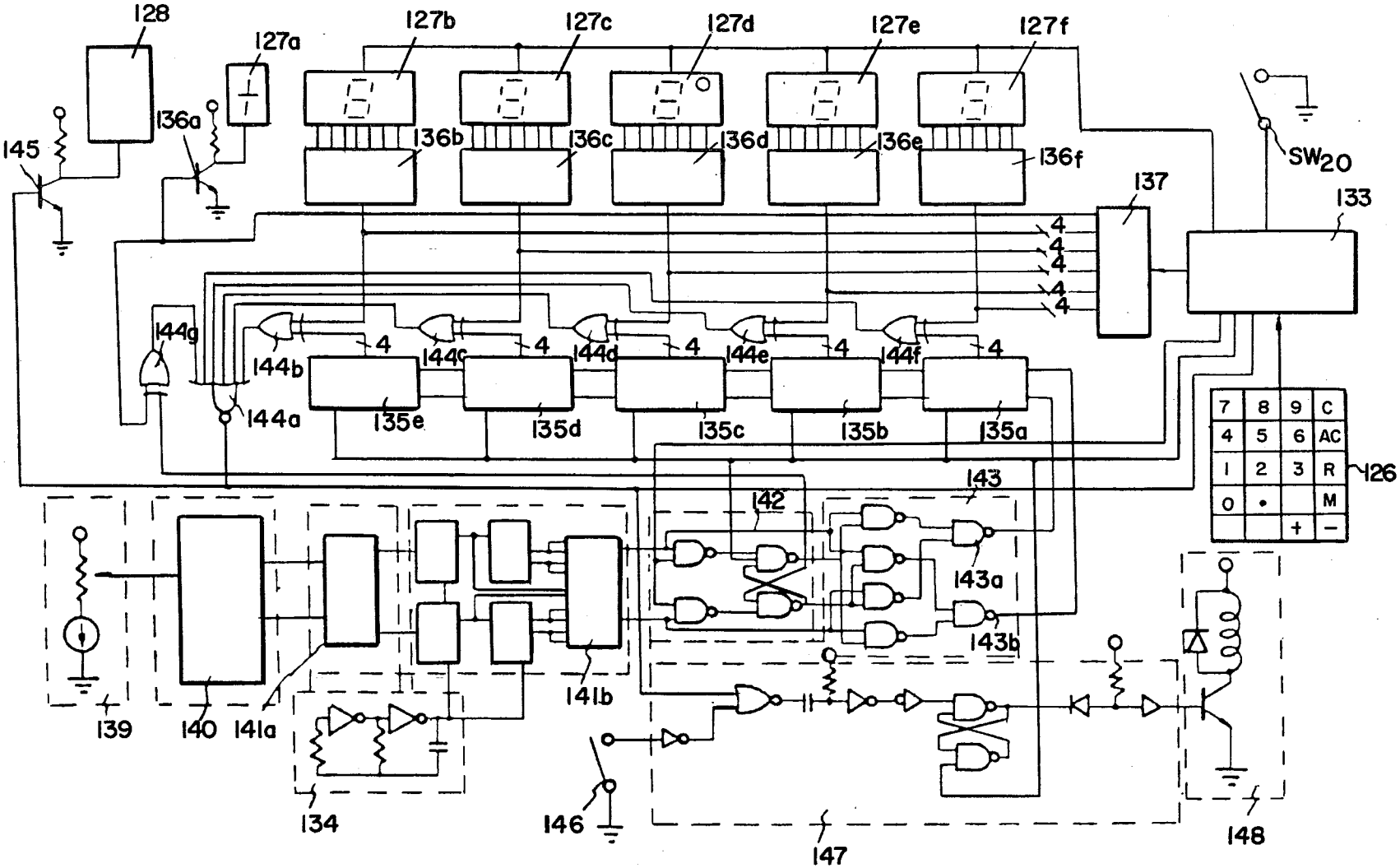
FIG. 7 is an electric circuit diagram illustrating the FIG. 4 embodiment.

The electric circuitry of FIG. 7 constructed according to the device of this invention will be described.

The voltage (indicative of the displaced angle) detected by the analog detector 139 is A-D converted by the A-D converter 140 and then divided by a multiplexer 141*a* into a sin signal and a cos signal. After being quadruplexed and direction-discriminated by a quadruplex pulse direction-discriminator 141*b*, these sin and cos signals are input into a polarity discriminator 142, on one side, and into an up-and-down control 143 on the other in which the up signal is discriminated 143*a* and the down signal is discrimby 143*b*. Thus these up and down signals are input into the up-and-down counters 135*a* to 135*e*.

A preset angle signal input by the key board 126 is input via the control circuit 133 into the shift register 137. The angle signal from the up-and-down counters and the preset angle signal from the shift register 137 are input into gates 144*a* to 144*g* forming a comparator. When there occurs a coincidence between the angle signal and the preset angle signal input into the comparator the analog detector and the desired angular voltage, an angular coincidence signal is output from said comparator. Such coincidence is displayed on the display station 128 under action of a coincidence display driver 145 and simultaneously the coincidence signal is input into a solenoid driver 147 causing a solenoid 148 to actuate the braking means. Reference numeral 46 designates a manual brake switch, 136*b* decoder driver, and 127*b* to 127*f* numerical value display stations.

With the universal parallel ruler constructed as described hereinabove according to the present invention, a basic line position is set by aligning the scale with a basic line for drawing on the drawing board with the pawl 18 engaged into the notches 17*a* formed in the index disc 117 of the basic line adjusting member 115. Then the basic line locking lever 116 is clamped to lock the basic line adjusting member 115, thereafter the all-clear key AC is depressed after closure of the source switch $SW_1$, and then a desired angle to be set is input on the key input station 126 and thereupon a digital display of the angle is obtained together with a polarity thereof on the numerical value display station 127. After the angle to be set has been verified on the basis of said digital display, the index lever 119 is pushed so as to disengage the pawl 118 from the noches 117*a* of the index disc 117 and the scale is rotated. Rotation amount of the head shaft 104 is detected as a rotation amount of the rotary shaft 106*a* of the analog detector 106 and electrically detected by the analog detector circuit 139. The rotation amount is supplied, after converted by the A-D converter 40 into the corresponding digital signal, to the comparator 138 in which this detection signal corresponding to the actual scale angle is compared with the rotation angle signal applied into the key input station. When a coincidence is established between these two signals, the comparator 138 provides a coincidence signal in response to which, the solenoid driver 147 and the braking solenoid 148 of the electromagnetic braking means 130 are activated by the control circuit 133 and thereby the scale is stopped and the display means or the light emitting element 128 is lit. Accordingly, the operator can immediately verify that the scale has been correctly set to the desired angle without observing various instruments such as the protractor as has usually been required. In other words, the operator can obtain a display of the scale rotation angle to be set, together with the polarity thereof on the numerical value display station and then set the scale to the desired angle simply by rotating the scale to a position at which the scale is stopped by the electromagnetic braking means. The embodiment shown may be arranged, as seen from FIG. 4, so that assembly of the key input station 126 and the numerical value display station 127 may be a computer commercially available. Such computer can be conveniently used also for conversion of measurements or like which may be associated with the normal operation of drawing. Furthermore, it is obviously possible to replace the analog detector 106 by a suitable digital detector such as encoder. It is also possible to replace the display means adapted to be lit when the scale reaches the position to be set by a buzzer or like which is activated to indicate positioning of the angle to be set. Moreover, the protractor and the index graduations interposed between the basic line adjusting member 115 and the casing member 125 as in the conventional arrangement can be used with the present invention.

It will be understood from the aforegoing description that the universal parallel ruler according to the present invention enables the angular setting of the scale to be substantially facilitated, improves the efficiency of the drawing operation and achieves the objects of the present invention as set forth in the introductory part of this specification.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for angular setting a preset member in a universal parallel ruler, a scale rotating into contact with said preset member, said device comprising:

input means for introducing a given first angular amount by which said scale is to be set, said first angular amount representing a new position for said preset member;

digital display means for displaying said first angular amount which has been introduced via said input means;

drive means responsive to actuation of said input means for rotating said preset member by a second angular amount; and locking means for locking said scale when said second angular amount of the rotated preset member substantially equals the first angular amount displayed on said digital display means and introduced via said input means.

2. A device for angular setting a scale in a universal parallel ruler according to claim 1, wherein said input means comprises key input means, said first angular amount being introduced in digital form.

3. A device for angular setting a scale in a universal parallel ruler according to claim 1, wherein said input means comprises a rotary dial input means, said first angular amount being introduced in analog form.

4. A device for angular setting a preset member in a universal parallel ruler, a scale rotating into contact with said preset member, said device comprising:

input means for introducing a given angle by which said scale is to be set, said given angle representing a new position for said preset member;

digital display means for displaying said given angle which has been input via said input means;

drive means for rotating said preset member by an angular amount in response to actuation of said input means; and locking means for preventing the rotation of said preset member and for locking said preset member when said angular amount of the rotated preset member equals said given angle, said locking means including a mechanism for transmitting a rotary drive from said drive means to said preset member, said mechanism preventing the rotary drive from being transmitted from said drive means to said preset member when said angular amount equals said given angle thereby preventing said angular amount of the rotated preset member from exceeding said given angle introduced via said input means.

5. A device for angular setting a preset member in a universal parallel ruler, a scale rotating into contact with said preset member, said device comprising:

input means for introducing a given angle by which said scale is to be set, said given angle representing a new position for said preset member relative to a basic line;

digital display means for displaying said given angle which has been input via said input means;

drive means for rotating said preset member by an angular amount in response to actuation of said input means;

means for braking said preset member when said angular amount is approximately equal to said given angle, said scale capable of rotating to a position corresponding to the location of said preset member;

locking means for locking said scale when said scale is rotated to said position corresponding to the location of said preset member;

said input means including, an input station means for entering said given angle, said input station means developing a signal in response to entry of said given angle;

said drive means driving said preset member to said new position in response to said signal from said input station means; and a switching mechanism means for activating when said preset member has been rotated to said new position, the activation of said switching mechanism means stopping the driving effect of said drive means.

6. A device for angular setting a preset member in a universal parallel ruler, a scale being rotated into contact with said preset member, said device comprising:

input means for introducing a given angle by which said scale is to be set, said given angle representing a new position of said preset member relative to a basic line;

digital display means for displaying said given angle which has been input via said input means;

drive means for rotating said preset member in response to activation of said input means;

means for braking said preset member when said drive means has rotated said preset member to an angular position corresponding to said given angle;

locking means for locking said scale at said angular position corresponding to said given angle;

said means for braking including, a rotation limiting switch mechanism means interposed between a rotatable part which is rotatable relative to said preset member and a stationary part which is stationary relative to said preset member for activating when said angular amount of said preset member substantially equals said given angle introduced via said input means.

7. A device for angular setting a preset member in a universal parallel ruler, a scale being rotated into contact with said preset member, said device comprising:

input means for introducing a given angle by which said preset member is to be set;

digital display means for displaying said given angle which has been input via said input means;

drive means for rotating said preset member by an angular amount in response to actuation of said input means;

means for braking said preset member at an angular position when said angular amount corresponds to said given angle;

locking means for locking said scale at said angular position corresponding to said given angle after said scale has been rotated into engagement with said preset member;

said input means including, an input station means for introducing a first signal in response to actuation thereof, said first signal effecting addition to and subtraction from said given angle thereby developing a second signal representative of the results of the addition and subtraction operations; and said drive means driving said preset member to a new angular position in response to said second signal from said input station means.

8. A device according to claim 7, wherein said digital display means displays a first set of numerical values corresponding to said angular amount of said angular position;

said digital display means displays a second set of numerical values corresponding to said angular amount of said new angular position.

9. A device for angular setting a preset member in a universal parallel ruler, a scale being rotated into engagement with said preset member, said device comprising:

input means to input a given angle representing a desired angular setting of said preset member;

digital display means for displaying said given angle;

drive means responsive to acutation of said input means to rotate said preset member by an angular amount until said angular amount is approximately equal to said given angle;

means for braking the rotation of said preset member at said desired angular setting when said angular amount is approximately equal to said given angle, said scale being rotated to said desired angular setting;

locking means to lock the scale at said desired angular setting; and a clear input station means in juxtaposition with said input means and responsive to actuation of said input means for generating a signal to clear the given angle displayed on said digital display means to zero, the position of said scale at said desired angular setting being used as a new basic line position for said universal parallel ruler.

10. A device according to claim 1 wherein said input means and said digital display means comprise a computer means.

11. In a universal parallel ruler including a scale and a scale setting device, said scale setting device comprising:

input station means for introducing a scale angle into said universal parallel ruler and for developing an output signal indicative of said scale angle;

numerical value display station means for digitally displaying said scale angle introduced via said input station means;

detector means for detecting an actual angular position of said scale and developing an output indicative thereof;

comparator means responsive to said output from said input station means and said detector means for comparing said scale angle introduced via said input station means with the output of said detector means and generating a coincidence signal in response to the coincidence between said output of said input station means and the output of said detector means; and display means activated in response to said coincidence signal developed from said comparator means for indicating that the scale has been correctly set to a position corresponding to said scale angle.

12. In a universal parallel ruler having a rotatable scale and including a scale setting device, said scale setting device comprising:

input station means for introducing a scale angle thereinto;

numerical value display station means for displaying said scale angle;

detector means for detecting an actual angular position of said scale;

comparator means for comparing said scale angle introduced via said input station means with an output from said detector means and generating a coincidence signal in response to the coincidence between said scale angle and said output from said detector means; and electromagnetic braking means activated in response to said coincidence signal from said comparator means for preventing the rotation of said scale when a desired angular position is achieved corresponding to said scale angle displayed on said numerical value display station means.

* * * * *